US005078325A

United States Patent [19]

Waryu et al.

[11] Patent Number: 5,078,325

[45] Date of Patent: Jan. 7, 1992

[54] COATING DISPENSER WITH REMOVABLE VALVE TIP AND VALVE SEAT

[75] Inventors: Joseph C. Waryu, Amherst; Thomas A. Loparo, Elyria, both of Ohio

[73] Assignee: Nordson Corporation, Westlake, Ohio

[21] Appl. No.: 584,463

[22] Filed: Sep. 18, 1990

[51] Int. Cl.[5] ..... B05B 1/00

[52] U.S. Cl. ..... 239/526; 239/583; 239/600

[58] Field of Search ..... 239/600, DIG. 14, 526, 239/583, 584

[56] References Cited

U.S. PATENT DOCUMENTS

| | | | |
|---|---|---|---|
| 2,936,959 | 5/1960 | Nord et al. . | |
| 2,969,926 | 1/1961 | Peeps | 239/583 |
| 3,490,701 | 1/1970 | Malec | 239/584 |
| 3,583,632 | 6/1971 | Shaffer | 239/583 |
| 3,633,828 | 1/1972 | Larson | 239/DIG. 14 |
| 3,690,518 | 9/1972 | Baker et al. . | |
| 3,731,145 | 5/1973 | Senay . | |
| 3,818,930 | 6/1974 | Crum et al. . | |
| 3,836,082 | 9/1974 | Krohn | 239/526 |
| 3,840,158 | 10/1974 | Baker et al. . | |
| 3,893,627 | 7/1975 | Siczek et al. | 239/583 |
| 3,960,296 | 6/1976 | Nord . | |
| 3,973,697 | 8/1976 | Crum et al. . | |
| 4,026,440 | 5/1977 | Crum et al. . | |
| 4,162,042 | 7/1979 | Mommsen et al. | 239/526 |
| 4,163,520 | 8/1979 | Garcin et al. . | |
| 4,241,880 | 12/1980 | Hastings . | |
| 4,266,721 | 5/1981 | Sickles . | |
| 4,273,293 | 6/1981 | Hastings . | |
| 4,335,851 | 6/1982 | Hastings . | |
| 4,381,081 | 4/1983 | Hastings . | |
| 4,430,886 | 2/1984 | Rood . | |
| 4,579,255 | 4/1986 | Frates et al. | 239/583 |
| 4,651,932 | 3/1987 | Huber et al. . | |
| 4,708,292 | 11/1987 | Gammons | 239/600 |
| 4,824,026 | 4/1989 | Tamura et al. . | |
| 4,886,013 | 12/1989 | Turner et al. . | |

*Primary Examiner*—Andres Kashnikow
*Assistant Examiner*—Lesley D. Morris
*Attorney, Agent, or Firm*—Wood, Herron & Evans

[57] ABSTRACT

A coating dispenser such as a spray gun which is particularly adapted for the application of a protective coating material onto metal can bodies comprises a gun body formed with a liquid passageway which carries the valve stem of a needle valve. In the presently preferred embodiment, the lowermost end or valve tip of the needle valve, and a valve seat, are carried within a valve seat block which is secured to the base of the gun body. A threaded connection is provided between the valve tip in the valve seat block, and the valve stem within the gun body, so that the valve tip, valve seat and valve seat block can be removed and replaced as a unit when the valve tip and/or valve seat become worn. Pins connected to the valve stem, and to the valve tip, are carried within slots in the gun body and valve seat block, respectively. These pins prevent rotation of the valve stem relative to the gun body and the valve tip relative to the valve seat block when they are threaded into and out of engagement with one another.

12 Claims, 2 Drawing Sheets

COATING DISPENSER WITH REMOVABLE VALVE TIP AND VALVE SEAT

FIELD OF THE INVENTION

This invention relates to coating dispensers for use in applying coating material in high speed production lines and, more particularly, to a coating dispenser having a valve tip and valve seat which are removable as a unit or separately for repair or replacement without disturbing the coating supply line, electric and/or pneumatic lines and the mounting structure associated with the coating dispenser.

BACKGROUND OF THE INVENTION

A variety of products produced on high speed production lines require the application of coating material to form a protective layer thereon. For example, the production of metal cans involves dispensing a thin film of lacquer or other protective coating onto the can ends or can bodies to protect the contents of the can against metal contaminants. Commercially available lines for the production of metal cans run at speeds on the order of about 400 to 700 cans per minute, and for some applications a coating dispenser such as a spray gun must be turned on and off at the frequency of the cans moving past the spray gun.

Spray guns for coating the ends and/or interior of metal cans are disclosed, for example, in U.S. Pat. Nos. 4,886,013 and 4,430,886 which are owned by the assignee of this invention. Spray guns of this type have proven to be effective in applying the desired protective coating onto the ends and/or interior of metal cans, even at high line speeds, but the valve mechanism associated with such spray guns which starts and stops the flow of coating material to the cans eventually wears out after a large number of cycles. Periodically, the valve tip, valve seat, seals and other elements of the valve mechanism of the spray gun must be replaced because of wear.

Maintenance of the spray guns employed in high speed production lines such as can coating lines has been a problem in the past. The downtime required to repair or replace worn elements of spray guns is costly, particularly considering the high speed of operation of the production lines in which the spray guns are utilized. One solution to this problem has been to employ spray guns which are modular in construction to reduce the time required for the repair or replacement of various components of the coating apparatus, particularly the valve mechanism and associated seat which turns on and off the flow of coating material discharged from the gun.

One problem with spray guns of this type is that such repairs must be effected "off line", i.e., with the spray gun removed from the production line. This requires the coating supply lines, electric lines and/or air lines associated with the gun to be disconnected, as well as the mounting structure which retains the spray gun in position with respect to the object such as metal cans moving therepast. After the spray gun is repaired, it must then be reattached to the mounting structure and to the various supply lines before operation of the can production line can be resumed. These delays are costly and there is a need for reducing the time required for the repair or replacement of various parts of spray guns used in metal can manufacturing lines and other high volume production lines.

SUMMARY OF THE INVENTION

It is therefore among the objectives of this invention to provide a coating dispenser, particularly for the application of protective coating material to metal cans, having a valve mechanism which is repairable or replaceable on-line.

These objectives are accomplished in a coating dispenser such as a spray gun which is particularly adapted for the application of a protective coating material onto metal can bodies comprising a gun body formed with a liquid passageway which carries the valve stem of a needle valve. In the preferred embodiment, the lowermost end or valve tip of the needle valve, and a valve seat, are carried within a valve seat block. A threaded connection is provided between the valve tip in the valve seat block, and the valve stem within the gun body, so that the valve tip and valve seat can be removed and replaced as a unit when either element becomes worn. Pins connected to the valve stem of the needle valve, and to its valve tip, are carried within slots formed in the gun body and valve seat block, respectively. These pins substantially prevent rotation of the valve stem and valve tip with respect to the gun body and valve seat block, respectively, when they are threaded into and out of engagement with one another.

In an alternative embodiment, the end of the valve stem is equipped with a collet which removably receives in a snap fit relationship a needle valve stem extension having a large ball formed on one end and a smaller ball formed on the other end. The larger ball snaps into the collet to secure the stem extension to the valve stem. The smaller ball comprises the needle valve end, and is engageable with a correspondingly formed valve seat which is carried in a valve seat holder or block. The valve seat block is secured to the gun body by a retaining nut. This design permits the needle valve stem extension and valve seat to be separately removed from the gun body without disturbing the placement of the gun body or remainder of the spray gun.

In either embodiment, this invention is therefore predicated upon the concept of permitting repair and/or replacement of the valve tip and associated valve seat of the spray gun, as a unit, or separately, without disturbing the remainder of the spray gun during the replacement process. The coating supply lines, electric or pneumatic lines and mounting structure for the spray gun can all remain in place as the valve tip and valve seat are removed and replaced. It has been found that the valve tip and valve seat elements are among the parts of the spray gun which are most susceptible to wear and/or failure, and thus it is desirable to permit their repair or replacement as quickly as possible and with the least amount of disruption to the production line.

In the presently preferred embodiment, the coating dispenser is a solenoid-operated spray gun having an armature reciprocated by the coil of a solenoid which, in turn, moves the valve stem of the needle valve axially within the liquid passageway formed in the gun body. A roll pin is fixedly mounted to the valve stem of the needle valve and this roll pin is axially movable within a pair of slots formed adjacent to the liquid passageway in the gun body. The pin permits axial motion of the valve stem along the liquid passageway, but rotation of the valve stem with respect to the gun body is substantially prevented. Similarly, a roll pin is fixedly mounted to the valve tip in the valve seat block, and this pin is axially movable within a pair of slots formed on either side of a discharge outlet in the valve seat block. Rotation of the valve tip relative to the valve seat block is substantially prevented by this roll pin.

The upper end of the valve tip is formed with a bore having internal threads which are matable with external threads formed on an extension at the base of the valve stem of the needle valve. In order to connect the valve seat block which carries the valve tip onto the gun body, the valve tip is first threaded onto the extension of the valve stem. The roll pins associated with the valve stem and valve tip prevent their rotation within the gun body and valve seat block, respectively, so that the valve tip and valve stem can be assembled. As the valve stem and valve tip of the needle valve are threaded together, the valve seat block is moved near an extension formed at the base of the gun body. This extension includes one or more locking pins engageable with corresponding slots formed at the top of the valve seat block which prevent rotation of the valve seat block as it is secured into place against the extension of the gun body by a retaining nut.

With the valve seat block in place against the extension of the gun body, the discharge bore in the interior of the valve seat block communicates with the liquid passageway in the gun body forming a path for the flow of coating material from the gun body into the valve seat block. Flow of coating material from the discharge bore of the valve seat block is controlled by movement of the valve tip between an open and closed position relative to the valve seat. In the presently preferred embodiment, the valve tip has a ball-shaped end, and the valve seat is correspondingly formed. In the open position, coating material is permitted to flow through the valve seat and into the discharge outlet of a nozzle which is connected by a nozzle nut to the base of the valve seat block.

DESCRIPTION OF THE DRAWINGS

The structure, operation and advantages of the presently preferred and alternative embodiments of this invention will become further apparent upon consideration of the following description, taken in conjunction with the accompanying drawings, wherein.

DETAILED DESCRIPTION OF THE INVENTION

Figure 1:
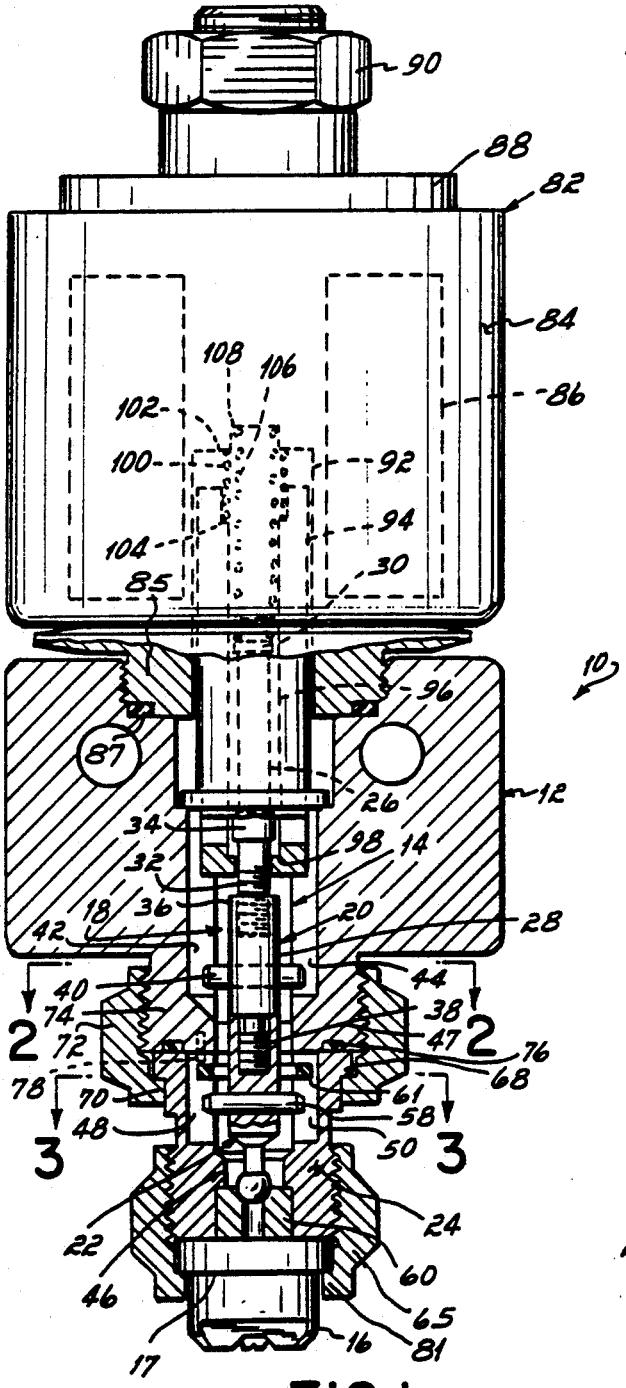
FIG. 1 is an assembled elevational view, in partial cross section, of a spray gun employing the removable valve seat block of the preferred embodiment of this invention.

Referring now to FIG. 1 which shows the presently preferred embodiment, a spray gun 10 is illustrated which generally comprises a gun body 12 formed with a liquid passageway 14 which discharges liquid coating material through a nozzle 16 communicating with the body 12. A needle valve 18 is axially movable within the liquid passageway 14 to control the flow of liquid to the nozzle 16. This invention is directed to the construction of the lower portion of the spray gun 10, and to the needle valve 18.

The needle valve 18 is formed with a two-piece valve stem 20 carried within the liquid passageway 14 of dispenser body 12, and a valve tip 22 carried within a valve seat block 24 as described below. The valve stem 20 includes an upper portion 26 and a lower portion 28 which are axially movable along the liquid passageway 14, as described in more detail below. The upper portion 26 of valve stem 20 has a flange 30 mounted to its top end, a threaded lower end 32 and a sleeve 34 located intermediate the flange 30 and threaded lower end 32. The lower portion 28 of valve stem 20 is tubular in shape having an internally threaded upper end 36 and a lower end which mounts a threaded extension 38. The upper and lower portions 26, 28 of the valve stem 20 are removably interconnected to one another by threading the lower end 32 of upper portion 26 into the internally threaded upper end 36 of the lower portion 28.

In the presently preferred embodiment, a roll pin 40 is fixedly mounted to the lower portion 28 of valve stem 20. A pair of opposed, longitudinally extending slots 42 and 44 are formed in the dispenser body 12 on either side of the liquid passageway 14, each of which receive one end of the roll pin 40 mounted to the valve stem 20. The roll pin 40 is axially movable within the slots 42, 44 as the valve stem 20 is reciprocated within the liquid passageway 14, as described below. But rotation of the valve stem 20 with respect to the dispenser body 12 is substantially prevented by engagement of the ends of the roll pin 40 with the edges of slots 42, 44, for purposes to become apparent below.

Referring now to the lower portion of FIG. 1, and FIGS. 2-5, the construction of the valve seat block 24 of this invention is illustrated in detail. The valve seat block 24 is formed with a stepped throughbore 46 and a pair of longitudinally extending slots 48 and 50 on either side of the throughbore 46. The valve tip 22 of needle valve 18 is located within the stepped throughbore 46 and is formed with an internally threaded bore 47 at its upper end which is matable with the threaded extension 38 of valve stem 20, as described below. The lower end of valve tip 22 which comprises the needle valve end is ball-shaped and is engageable with a correspondingly formed valve seat 60. A roll pin 58 is fixedly mounted to the valve tip 22, and the opposed ends of this roll pin 58 extend within the slots 48, 50 adjacent to the stepped throughbore 46. The roll pin 58 permits axial movement of the valve tip 22 along the stepped throughbore 46 with respect to a valve seat 60 mounted to or integrally formed with the valve seat block 24 at the base of throughbore 46. Rotation of the valve tip 22 relative to the valve seat block 24 is substantially prevented, however, by engagement of the roll pin 58 with the edges of the slots 48, 50 in valve seat block 24.

Preferably, the valve tip 22 is retained within the stepped throughbore 46 by an 0-ring 61 which is interposed between an overhanging, annular flange 62 formed at the top of the valve seat block 24, and the roll pin 58. The flange 62 is formed with opposed slots 63, 64 which permit insertion of the ring 61 within the interior of the valve seat block 24, in between the flange 62 and roll pin 58. In the event of an upward movement of the valve tip 22, the ring 61 engages the overhanging flange 62 and the roll pin 58 contacts the ring 61, thus retaining the valve tip 22 within the valve seat block 24.

The lower portion of the wall of valve seat block 24 is formed with external threads which are adapted to mate with the internal threads of a nozzle nut 65. The upper portion of the wall of valve seat block 24 is formed with flats 66 adapted to receive a tool such as a wrench, and an annular shoulder 68 which provides a seat for the lower flange 70 of a retaining nut 72. This retaining nut 72 has internal threads which engage the external threads of a dispenser body extension 74 projecting downwardly from the base of dispenser body 12. Preferably, the extension 74 has a recess which carries an 0-ring 76 engageable with the top surface of valve seat block 24. At least two locking pins 78 project downwardly from the extension 74 which are engageable with slots 80 formed at the top end of the valve seat block 24. See FIGS. 4 and 5.

Figure 4:
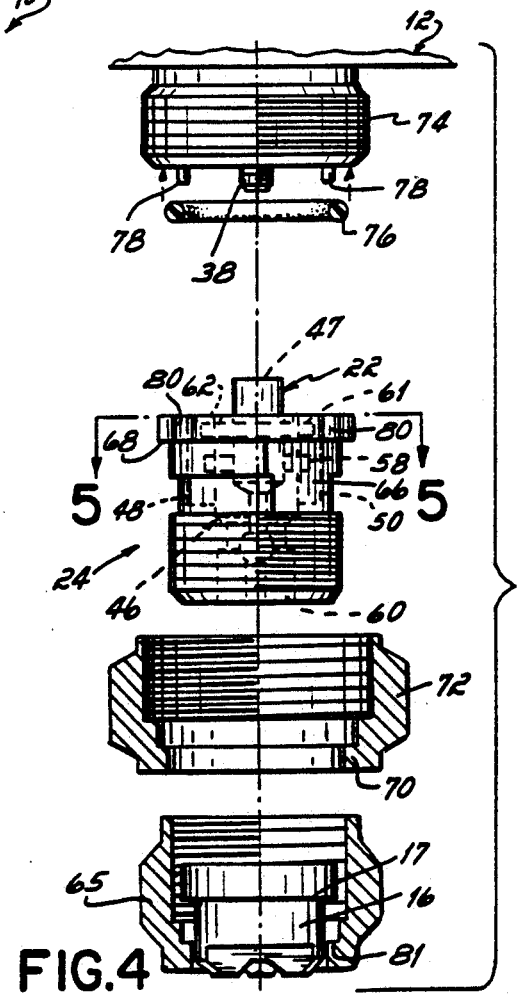
FIG. 4 is a disassembled, elevational view in partial cross section of the lowermost portion of the coating dispenser shown in FIG. 1.
Figure 5:
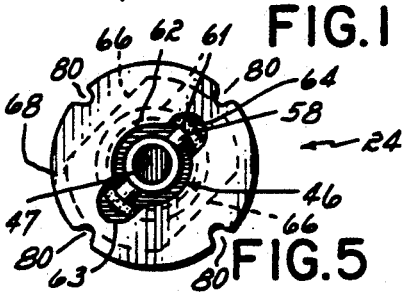
FIG. 5 is a plan view taken generally along line 5—5 of FIG. 4.

An important aspect of this invention is that the valve seat block 24, including the valve tip 22 and valve seat 60, can be assembled and disassembled as a unit from the dispenser body 12 quickly and easily and without disturbing the remainder of the spray gun 10. With reference to FIGS. 1 and 4, an assembly operation proceeds as follows. Initially, a new O-ring 76 is inserted within the recess at the base of the dispenser body extension 74 to ensure a fluid-tight seal is created between the extension 74 and the valve seat block 24. The valve tip 22 is then threaded onto the valve stem 20 of needle valve 18 by engagement of the threaded extension 38 of the lower portion 28 of valve stem 20 with the internally threaded bore 47 at the top end of the valve tip 22. The flats 66 on the outside of valve seat block 24 can be utilized to assist in threading the valve tip 22 and valve stem 20 together using a tool such as a wrench (not shown). As described above, the valve stem 20 is substantially prevented from rotating within the gun body 12 because of the engagement of roll pin 40 with the edges of slots 42, 44 in the gun body 12, and the valve tip 22 is substantially prevented from rotating within the valve seat block 24 because of the engagement of roll pin 58 with the slots 48, 50 in the valve seat block 24. With the valve stem 20 and valve tip 22 thus maintained rotatably fixed relative to the gun body 12 and the valve seat block 24, the interconnection of the valve stem 20 and valve tip 22 can proceed until the top surface of the valve tip 22 engages the bottom surface of valve stem 20. In this position, the top of valve seat block 24 is located adjacent the dispenser body extension 74, with the O-ring 76 interposed therebetween. As viewed in FIG. 1, the extension 38 of the valve stem 20 is allowed to bottom out against the base of the threaded bore 47 in the valve tip 22, before the valve seat block 24 contacts the dispenser body extension 74, due to the axial movement of the valve stem 20 which is permitted within the liquid passageway 14.

Figure 2:
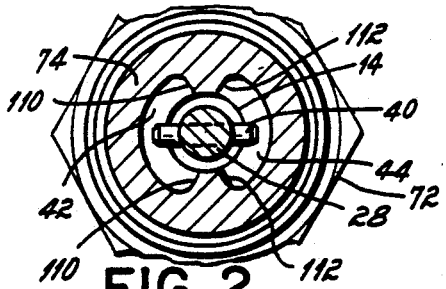
FIG. 2 is a cross sectional view taken generally along line 2—2 of FIG. 1.
Figure 3:
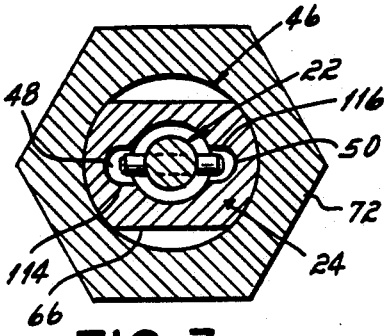
FIG. 3 is a cross sectional view taken generally along line 3—3 of FIG. 1.

As viewed in FIGS. 2 and 3, the slots 42, 44 in the gun body 12, and, to a lesser extent, the slots 48, 50 in the valve seat block 24, are larger in dimension than the diameter of the roll pins 40 and 58, respectively. That is, the dimension or distance between the opposed edges 110 and 112 of each slot 42, 44 in gun body 12 is greater than the diameter of roll pin 40, and the distance between the opposed edges 114 and 116 of each slot 48, 50 in the valve seat block 24 is greater than the diameter of roll pin 58. Limited rotation of the roll pin 40 within slots 42 and 44 in the gun body 10, and limited rotation of the roll pin 58 within slots 48 and 50 in the valve seat block 24, is thus permitted so that the locking pins 78 at the base of dispenser body extension 74 can be inserted within the slots 80 formed in the top of valve seat block 24.

In order to mount the valve seat block 24 onto the dispenser body extension 74, the retaining nut 72 is threaded onto the dispenser body extension 74 so that the lower flange 70 at the base of retaining nut 72 engages the annular shoulder 68 in the valve seat block 24. As the retaining nut 72 is tightened, the locking pins 78 prevent rotation of the valve seat block 24 relative to the dispenser body 12 thus allowing the valve seat block 24 to firmly seat against the dispenser body extension 74 and O-ring 76. Assembly is completed by affixing the nozzle 16 to the base of valve seat block 24 by engagement of the nozzle nut 65 with the external threads along the lower portion of valve seat block 24. As viewed in FIGS. 1 and 4, the nozzle 16 is preferably formed with a shoulder 17 which engages an annular flange 81 at the base of the nozzle nut 65 to retain the nozzle 16 upon the base of valve seat block 24.

Disassembly of the valve seat block 24 from the gun body 12 is accomplished by essentially reversing the above-described operation. The nozzle nut 65 is first disconnected from the valve seat block 24 which disengages the nozzle 16 therefrom. The retaining nut 72 is then unthreaded from the dispenser body extension 74 which exposes the flats 66 formed in the valve seat block 24. In order to disengage the alignment pins 78 from the alignment slots 80 at the top of the valve seat block 24, the valve seat block 24 and needle valve 18 is pulled downwardly a short distance by hand. Using the flats 66 and a wrench, the valve seat block 24 can be rotated to unthread the valve tip 22 from the valve stem 20 and thus disengage the valve seat block 24 from the gun body 12.

Figure 6:
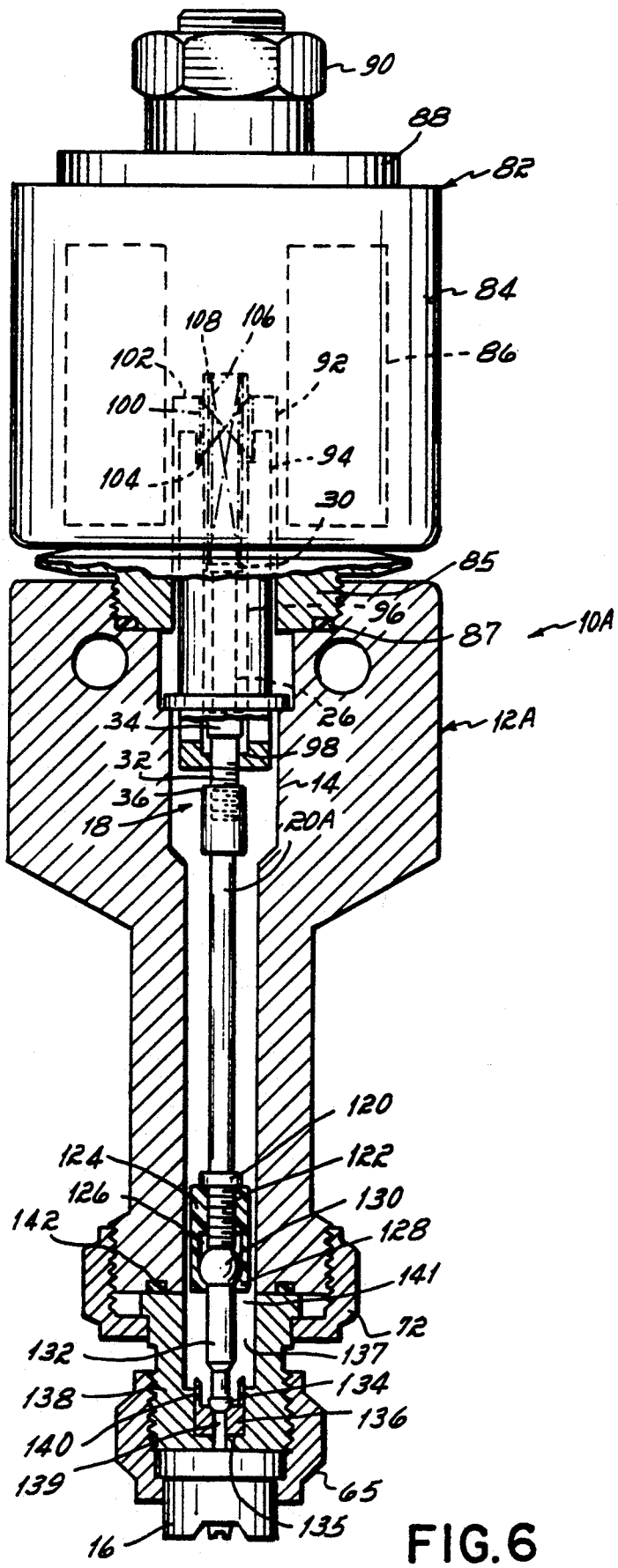
FIG. 6 is an assembled elevational view, in cross section, of an alternative embodiment of this invention.

With reference to FIG. 6, an alternative embodiment of this invention is illustrated which is similar in many respects to the embodiment of FIGS. 1–5 except for the removal and replacement of the valve seat and valve tip. As described in connection with FIGS. 1–5, repair or replacement of the valve tip 22 and valve seat 60 is accomplished by unthreading the valve tip 22 from the valve stem 20 so that the valve seat block 24, valve tip 22 and valve seat 60 can be removed as a unit from the remainder of the gun body 12. In the embodiment of FIG. 6, such repair or replacement of the valve seat and valve tip is accomplished somewhat differently, but with the same objective of permitting repair and replacement thereof while the dispenser body 12 is on-line.

As illustrated in FIG. 6, the upper portion of the spray gun 10A, the solenoid 82 and housing 84 are identical to that disclosed in connection with FIGS. 1–5 and the same reference numbers are utilized in FIG. 6 to identify the same structure. The valve stem 20A of FIG. 6 is secured to the lower end 32 of sleeve 34 in the same manner as described above in FIG. 1, but the lower portion of valve stem 20A has a shoulder 120 and a threaded end 122 which mates with internal threads formed in a collet 124. The collet 124 is threaded onto the end 122 of valve stem 20A until it engages the shoulder 120. In the presently preferred embodiment, the collet 124 has a hollow interior 126 and a radially inwardly extending flange 128 at the entrance to the interior 126. This flange 128, and the walls of collet 124, are at least partially elastically deformed to receive a large ball end 130 of a needle valve extension 132. Preferably, the collet 124 is formed of a plastic material which exhibits sufficient elasticity to deform and receive the ball end 130, but retain it in place on the lower end of valve stem 20A.

The opposite end of the needle valve extension 132 is formed with a smaller ball 134 which engages a mating seat 136 mounted at the outlet 135 of a passageway 137 formed in a valve seat block 138. The valve seat 136 includes a bore 139 and an upstanding collar 140 having an internal diameter which is greater than the diameter of ball 134. In the course of extension and retraction of plunger 20A, as described above, the collar 140 guides the ball end 134 so that it remains axially aligned with the valve seat 136. The valve seat block 138 is mounted to the gun body 12A against an O-ring 142 by a retaining nut 72 in the same manner as valve seat block 24 described in connection with FIG. 1, so that the inlet 141 of its passageway 137 communicates with the passageway 14 in gun body 12A. A nozzle 16 is mounted to the valve seat block 138 with a nozzle nut 65 as also described above.

The above-described construction of the embodiment of FIG. 6 permits easy, on-line removal of both the valve seat 136 and needle valve extension 132 for repair or replacement as required. In order to remove the valve seat 136, the retaining nut 72 is unthreaded to disengage the valve seat block 138 from the gun body 12A while the needle valve extension 132 remains connected to the collet 124 carried in the gun body 12A by the needle valve 20A. Preferably, the valve seat 136 valve seat block 138 are fixedly mounted to one another and are removed and replaced as a unit.

Once the valve seat block 138 has been disconnected from the gun body 12A, the needle valve extension 132 can also be removed for repair or replacement. Preferably, the center portion of the needle valve extension 132, between the ball ends 130 and 134, is gripped with a tool such as vise grips or the like and pulled downwardly out of the collet 124 which separates it from the gun body 12A. It is contemplated that notches or other flats could be milled into opposite sides of the needle valve extension 132 between the balls 130 and 134 to facilitate gripping of the needle valve extension 132 to permit easier removal of the needle valve extension 132. A new needle valve extension 132 is installed by forcing the large ball end 130 into the collet 124 and then reattaching a new valve seat block 138 and valve seat 136 unit.

Having described the preferred and alternative embodiments of this invention, it can be appreciated that both the assembly and disassembly operations can be accomplished in either embodiment without disturbing the mounting structure which positions the gun body 12 relative to a metal can production line (not shown), or requiring disconnection of any fluid or electrical lines to the gun body 12 or 12A. Repair or replacement of the valve tip 22 and valve seat 60, or valve tip extension 132 and valve seat 136, is accomplished with the dispenser body 12 or 12A on-line, and thus a minimum amount of disruption to the can coating or other production line is created.

The remaining portions of the spray gun 10 form no part of this invention per se, and are thus described only briefly hereinafter for purposes of illustrating the means for reciprocating needle valve 18 with respect to the valve seat 60 or 136. A detailed discussion of the structure and operation of spray gun 10 can be found in U.S. Pat. No. 4,430,886 to Rood, owned by the same assignee as this invention, the disclosure of which is incorporated by reference in its entirety herein.

As shown in FIG. 1 and FIG. 6, the gun body 12 mounts a solenoid 82 having a housing 84 which contains a coil 86 retained therein by a cap 88 and nut 90. The lowermost end of the housing 84 has a reduced armature sleeve 85 which at its lower end is threaded into a bore formed in the gun body 12 with an O-ring 87 located between. The upper portion of armature sleeve 85 extends through housing 84 and has a threaded top end which mounts nut 90 so that the housing 84 can be tightened against the gun body 12. The solenoid housing 84 is formed with a bore 92 which receives an armature 94 extending at least partially into the coil 86. The armature 94 is tubular in shape and has a throughbore 96 which receives the upper portion 26 of valve stem 20. A radially inwardly extending flange 98 is formed at the base of armature 94 which is engageable with the sleeve 34 on the upper portion 26 of valve stem 20. A compression spring 100 is located between a shoulder 102 formed at the top of bore 92 and a seat 104 formed in the armature 94. A second compression spring 106 extends between a counterbore 108 formed in the solenoid housing 84 at the top of bore 92, and the flange 30 at the top of the upper portion 26 of valve stem 20.

When power is supplied to the coil 86 of solenoid 82, the armature 94 is pulled upwardly as viewed in FIG. 1 or FIG. 6 so that its lower flange or lip 98 engages the sleeve 34 in the upper portion 26 of valve stem 20 or 20A to pull the valve stem 20 or 20A upwardly therewith. In turn, the valve tip 22 or needle valve extension 132 is pulled upwardly with the valve stem 20 or 20A so that the valve tip 22 or extension 126 disengages the valve seat 60 or 136. This permits the flow of liquid from the liquid passageway 14 in the gun body 12, through the valve seat 60 or 136 into the nozzle 16 for discharge onto the interior of a can body or the like. De-energization of the solenoid 82 allows the compression springs 100 and 106 to return the armature 94 and needle valve 18 to a valve closed position in which the valve tip 22 or needle valve extension 136 engages the valve seat 60 or 136 and thus prevents the flow of liquid to the nozzle 16. As discussed above with respect to the presently preferred embodiment, movement of the needle valve 18 within the dispenser body 12 and valve seat block 24 is permitted by the roll pins 40 and 58 as they move within slots 42, 44 and 48, 50, respectively.

While the invention has been described with reference to a preferred embodiment and one alternate embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best and alternate modes contemplated for carrying out this invention, but that the invention will include all embodiments falling within the scope of the appended claims.

We claim:

1. A spray gun, comprising:

a gun body formed with a passageway for transmitting flowable material;

a valve seat block formed with a discharge bore having an inlet and an outlet;

a valve seat located at said outlet to said discharge bore in said valve seat block;

valve means for controlling the flow of material through said discharge bore in said valve seat block, said valve means including a valve stem carried within said passageway in said gun body and a valve tip carried within said discharge bore in said valve seat block;

means for interconnecting said valve stem and said valve tip so that said valve tip and said valve seat block can be simultaneously connected to said gun body in a position wherein said passageway of said gun body communicates with said discharge bore in said valve seat block, and so that said valve tip and said valve seat block can be simultaneously disconnected from said gun body.

2. A spray gun, comprising:

a gun body formed with a passageway for transmitting flowable material;

a valve seat block formed with a discharge bore having an inlet and an outlet;

a valve seat located at said outlet to said discharge bore in said valve seat block;

means for releasably securing said valve seat block to said gun body so that said inlet of said discharge bore communicates with said passageway to receive flowable material therefrom;

valve means for controlling the flow of material through said valve seat block, said valve means including:

(i) a valve stem carried within said passageway in said gun body;

(ii) a valve tip carried within said valve seat block in a position to engage said valve seat located at said outlet of said discharge bore;

(iii) means for releasably interconnecting said valve stem and said valve tip so that said valve tip and said valve seat block can be simultaneously connected to and disconnected from said gun body;

means for moving said valve stem and valve tip between an open position in which said valve tip disengages said valve seat to permit the flow of material through said valve seat block, and a closed position in which said valve tip engages said valve seat to prevent the flow of material through said valve seat block.

3. The spray gun of claim 2 in which said valve stem of said valve means comprises:

an upper portion having an externally threaded end;

a lower portion having a first end formed with an internally threaded bore and a second end formed with an externally threaded extension;

said externally threaded end of said upper portion of said valve stem being threadedly engageable with said internally threaded bore of said first end of said lower portion of said valve stem.

4. The spray gun of claim 3 in which said valve tip includes an upper end formed with an internally threaded bore, said internally threaded bore at said upper end of said valve tip being engageable with said externally threaded extension of said lower portion of said valve stem.

5. The spray gun of claim 2 in which said means for releasably interconnecting said valve stem and said valve tip comprises:

a first pin fixedly mounted to said valve stem, said first pin being engageable with at least one longitudinally extending slot formed in said gun body adjacent to said passageway therein;

a second pin fixedly mounted to said valve tip, said second pin being engageable with at least one longitudinally extending slot formed in said valve seat block adjacent to said discharge bore therein;

mating threaded sections formed on said valve stem and said valve tip to permit assembly and disassembly of said valve stem and valve tip;

said first pin being effective to substantially prevent rotation of said valve stem relative to said gun body in the course of assembly and disassembly of said valve stem and valve tip, and said second pin being effective to substantially prevent rotation of said valve tip relative to said valve seat block in the course of assembly and disassembly of said valve stem and valve tip.

6. The spray gun of claim 5 in which said valve seat block include an upper end formed with a radially inwardly extending flange, said valve seat block including a ring interposed between said second pin and said flange to retain said valve tip within said discharge bore in said valve seat block.

7. The spray gun of claim 2 in which said gun body is formed with at least one locking pin and said valve seat block is formed with at least one slot which receives said locking pin to prevent rotation of said valve seat block with respect to said gun body.

8. A spray gun, comprising:

a gun body formed with a passageway for transmitting flowable material, said gun body being formed with a pair of longitudinally extending slots on either side of said passageway;

a valve seat block formed with a discharge bore having an inlet and an outlet, said valve seat block being formed with a pair of longitudinally extending slots on either side of said discharge bore;

a valve seat located at said outlet to said discharge bore in said valve seat block;

means for mounting said valve seat block to said gun body so that said inlet of said discharge bore communicates with said passageway to receive material therefrom;

means for mounting a nozzle to said valve seat block in communication with said outlet of said discharge bore therein;

valve means for controlling the flow of material into said nozzle, said valve means including:

(i) a valve stem carried within said passageway in said gun body;

(ii) a first pin fixedly mounted to said valve stem, said first pin having opposed ends insertable within said slots in said gun body;

(iii) a valve tip carried within said valve seat block in a position to engage said valve seat located at said outlet of said discharge bore;

(iv) a second pin fixedly mounted to said valve tip, said second pin having opposed ends insertable within said slots in said valve seat block;

(v) mating threaded sections formed on said valve stem and said valve tip to permit assembly and disassembly of said valve stem and valve tip;

means for moving said valve stem and valve tip between an open position in which said valve tip disengages said valve seat to permit the flow of material into said nozzle, and a closed position in which said valve tip engages said valve seat to prevent the flow of material into said nozzle.

9. A spray gun, comprising:

a gun body formed with a passageway for transmitting flowable material;

a valve seat block formed with a discharge bore having an inlet and an outlet;

a valve seat located at said outlet to said discharge bore in said valve seat block;

means for releasably securing said valve seat block to said gun body so that said inlet of said discharge bore communicates with said passageway to receive flowable material therefrom;

valve means for controlling the flow of material through said valve seat block, said valve means including:

(i) a valve stem carried within said passageway in said gun body;

(ii) a valve tip having a first end formed with a ball and a second end which mates with said valve seat, said valve tip being carried within said valve seat block in a position wherein said second end thereof engages said valve seat located at said outlet of said discharge bore;

(iii) means for releasably interconnecting said ball at said first end of said valve tip and said valve stem so that said valve tip can be connected to and disconnected from said valve stem with said valve seat block removed from said gun body;

means for moving said valve stem and valve tip between an open position in which said valve tip disengages said valve seat to permit the flow of material through said valve seat block, and a closed position in which said valve tip engages said valve seat to prevent the flow of material through said valve seat block.

10. The spray gun of claim 9 in which said means for releasably interconnecting said valve tip and said valve stem comprises a collet connected to said valve stem, said collet being formed with a hollow interior having an entrance opening which is at least partially deflectable to receive said ball at said first end of said valve tip within said hollow interior of said collet, whereby said valve tip is releasably mounted to said valve stem.

11. The method of removing the valve tip and valve seat of a spray gun, comprising:

simultaneously rotating a valve tip, and a valve seat block which carries the valve tip and the valve seat, with respect to a valve stem carried within the gun body of the spray gun so that a first portion of the valve tip disengages a mating portion of the valve stem;

substantially preventing rotation of the valve stem with respect to the gun body and substantially preventing rotation of the valve tip with respect to the valve seat block in the course of simultaneously rotating the valve tip and the valve seat block relative to the valve stem so that the valve tip and the valve seat block are disengaged from the valve stem while the valve stem remains within the gun body.

12. The method of removing the valve tip and valve seat of a liquid spray gun, comprising:

removing a retaining nut which secures a valve seat block to the gun body of the liquid spray gun, the valve seat block carrying the valve seat and carrying the valve tip of a needle valve which controls the flow of liquid through the spray gun to a nozzle associated with the spray gun;

simultaneously rotating the valve tip and the valve seat block with respect to the gun body so that a threaded portion of the valve tip disengages a mating, threaded portion of a valve stem of the needle valve which is carried within the gun body;

substantially preventing rotation of the valve stem with respect to the gun body and simultaneously substantially preventing rotation of the valve tip with respect to the valve seat block as the threaded portion of the valve tip is disengaged from the mating, threaded portion of the valve stem.

* * * * *